US005183315A

United States Patent [19]

Takahashi et al.

[11] Patent Number: 5,183,315

[45] Date of Patent: Feb. 2, 1993

[54] INFANT RESTRAINING CHAIR

[75] Inventors: Takehiko Takahashi, Tokyo; Ryuji Iwata; Yuji Shimizu, both of Aichi, all of Japan

[73] Assignee: Combi Corporation, Tokyo, Japan

[21] Appl. No.: 884,046

[22] Filed: May 14, 1992

Related U.S. Application Data

[63] Continuation of Ser. No. 568,108, Aug. 16, 1990, abandoned.

[30] Foreign Application Priority Data

Oct. 12, 1989 [JP] Japan ..... 1-119520[U]

[51] Int. Cl.[5] ..... A47C 31/00

[52] U.S. Cl. ..... 297/488; 297/464

[58] Field of Search ..... 297/488, 487, 464, 867, 297/473, 216, 217

[56] References Cited

U.S. PATENT DOCUMENTS

| | | | |
|---|---|---|---|
| 326,184 | 9/1885 | White | 297/464 X |
| 2,822,442 | 9/1950 | Garris | 108/42 |
| 3,572,830 | 3/1971 | Storor | 297/467 |
| 4,065,179 | 12/1977 | Takasaki | 297/464 |
| 4,537,446 | 8/1985 | Koney et al. | 297/464 |
| 4,568,122 | 2/1986 | Cain | 297/488 |
| 4,579,191 | 4/1986 | Kess et al. | 297/488 X |
| 4,662,683 | 5/1987 | Kaoedler et al. | 297/488 |
| 4,790,593 | 12/1988 | Daracos et al. | 297/488 X |
| 4,813,746 | 3/1989 | Muchouand | 297/488 |
| 4,906,047 | 3/1990 | Mikami | 297/464 |

*Primary Examiner*—Jose V. Chen

*Attorney, Agent, or Firm*—Sughrue, Mion, Zinn, Macpeak & Seas

[57] ABSTRACT

An infant restraining chair for installation in a corner or other compact area of a bathroom, for restraining an infant while the infant's guardian makes use of bathroom facilities. A chair supporting and surrounding a substantial portion of an infant's body is mounted on top of a column having a cross-section of a generally triangular shape. Arcuate seat belt portions of substantially rigid construction are maintained in a body of the chair normally in a position retracted into the chair, but are selectably extendable out of the chair body to encircle and restrain an infant seated in the chair. A retraction arrangement utilizes force from gravity constantly to bias the seat belt portions into a retracted position. A mechanical locking arrangement may be provided for locking the seat belt portions in a restraining position.

10 Claims, 6 Drawing Sheets

INFANT RESTRAINING CHAIR

This is a continuation of application Ser. No. 07/568,108 filed Aug. 16, 1990, abandoned.

FIELD OF THE INVENTION

The present invention relates to an improvement for an infant chair for installation and use in public spaces such as public lavatories, public conveniences, or the like, where a large number of unspecified persons visit, and more particularly to an improvement for an infant chair which is constructed in such a manner that a protective frame provided in the main body of the chair is arranged to extend from the back part of the seat to enclose the front region of the chair at the height of an armrest, so that the infant seated in the said chair is confined and protected therewith for safety.

BACKGROUND OF THE INVENTION

It is proposed in the Official Gazette for Japan Utility Model Laid Open No. 100743-1986 that a chair for an infant be installed inside a lavatory compartment. However, the baby chair is a common-type chair with the main body thereof being composed of the back part and the seat part and with a handrail provided to extend from the back part at the height of the armrest to enclose the front region of the chair, and with a slip-preventing band being provided between the central region at the fore ends of the handrail and the central part of the front part of the seat.

The baby chair of the type mentioned above is ordinarily constructed with both the handrail and the slip-preventing band fixed rigidly, and consequently it is necessary to put the baby in the chair and to remove him from the chair from a point over the main body of the chair, and it is therefore necessary to lift the infant to a high level. It often happens that infant lifting cannot be done smoothly to set the infant in the chair and to remove him from the chair because the infants legs (often kicking) tend to interfere with the handrail and also with the slip-preventing band of the chair.

SUMMARY OF THE INVENTION

The present invention is directed to dealing adequately with the problems mentioned above in consideration of the circumstances described hereinabove. Specifically, an object of this invention is to offer an infant chair which can be set up easily and in a simple way, and is also provided with a protective frame structured so as to protect, confine and control the seated infant in safety and in a secure manner.

This invention has its essential features in a construction of an infant chair comprised of: a seat part, wherein the back part thereof is formed into the back support and the front part thereof is formed into an open region on an upper area of the main body of the chair which is formed in a columnar shape, a triangular shape, or another shape having an appropriate height; and, two semicircular arc protective frame members pivotably provided through a pair of rotating arms on a base plate in the inside area of the back support in a manner permitting the members to be drawn out freely, so as to encircle and confine the waist and front abdominal region of the infant from both sides of the back support, the protective frame members as drawn out as mentioned above, forming a state of their closure by their mutual contact or their proximity in the central area in the front part of the open region or by a locking means provided therefor, and being retractable or drawn automatically into the two sides of the above-mentioned back support provided in the above-mentioned main body of the chair at the same time as the locking means is released.

Further, the improved feature in a construction of the infant chair is that the semicircular arc frame members perform their rotating movement, thereby setting the base plate in the rear downward direction, which applies force to frame members in their opening direction.

Additionally, it is preferable that the locking means is formed symmetrically to the individual rotating arms, and specifically, is provided with a pair of locking pins, which are formed symmetrically, a pair of locking holes, into which the protective frame is jointed in the closed state, and a rotating motion locking plate, which is arranged on the base plate. The rotating motion locking plate is made in such a way as to be capable of rotating from a locking position to a lock release position by the operation of a lock release lever.

BRIEF DESCRIPTION OF THE DRAWINGS

The manner by which the above objects and other objects, features and advantages of the present invention are attained will be fully evident from the following detailed description when it is considered in light of the drawings, wherein.

BRIEF DESCRIPTION OF THE PREFERRED EMBODIMENTS OF THE INVENTION

Figure 1:
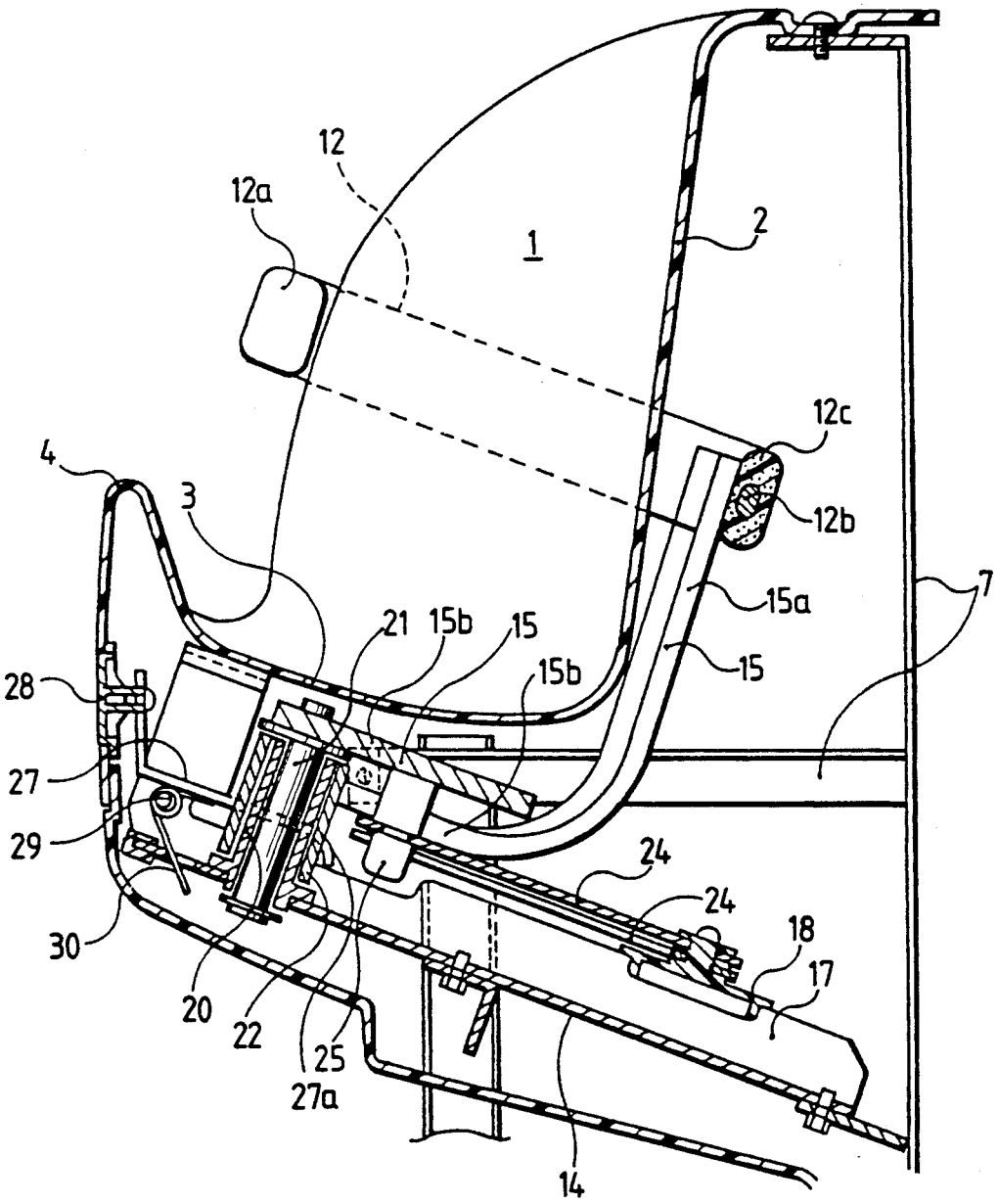
FIG. 1 is a sectional view of the principal parts in an embodiment of the infant chair according to the present invention.

Reference will now be made in detail to the construction according to the present invention as illustrated in the accompanying drawings.

In the description to follow, preferred embodiments of the present invention are presented as examples. It should be understood, however, that the present invention is not limited to these examples of its embodiment, but may be applied effectively to other forms which do not deviate from the technical scope of the present invention as defined in the appended claims.

An infant chair according to the present invention is described in detail with reference to an example of its embodiment. The basic construction of the chair is described below and illustrated in FIG. 2 and FIG. 3.

Reference numeral 1 represents a main unit 1 of the chair, and such main unit 1 is formed with a back support 2 and a seat part 3.

Moreover, the protective frame 11 is installed in such a way as to extend from the back support 2 to enclose the front area at the height of the armrest. Then, this example of an embodiment of the invention has a construction in which the main unit 1 is arranged as a single unit over the commodity container 5. The main unit 1 and the commodity container 5 can be made in separate units, but, in this embodiment, they are molded at one time into a single block made of plastic and designed to be installed with screws and clips or the like in a triangular columnar frame 7. Moreover, the commodity container 5 is provided with sliding doors 6, which are opened to both sides.

Also, a crotch holder 4 is formed in the central position on the front rim of the seat 3 of the main unit 1. The crotch holder 4 is formed together with the main unit 1 which is made of plastics and formed by injection molding, blow molding or the like. In practice, it is better to set a height of the crotch holder 4 as low as reasonably possible, so that the crotch holder will not be an obstacle to the seating of the infant in the chair. In contrast, the crotch holder should be of enough height (e.g., 3 cm to 5 cm) to prevent the infant from slipping forward as the result of the infant's usual movements when the child is seated with the crotch holder positioned between his thighs.

This embodiment in the above-mentioned construction has characteristic structural features as described below. A description is made of the characteristic features with reference to the FIG. 1 and FIG. 4 through FIG. 8.

The protective frame 11 is made in the form of a pair of semicircular arc frame members 12 divided symmetrically in the central part in the front end area, and the semicircular arc frame members 12 are fixed rigidly on each of the fore end parts of a pair of rotating arms 15 with the axis supported on a base plate 14 in such a manner as to permit a symmetrical rotating motion. As a result of such rotating motion, the individual fore end parts (the grip parts) 12*a* of the individual semicircular arc frame members 12 come into close contact with each other or into mutual proximity in the central part mentioned above, thereby forming a closed state. The individual semicircular arc frame members 12, when accommodated almost in their entirety in the inside area of the main body 1 of the chair, form an open state.

In specific terms, each semicircular arc frame member 12 takes as its basis shape a quarterly divided circumferential shape formed of a semicircumference of a circle as divided into two parts at the top, and the frame member is made by covering an insert 12*b* made of rigid resin or metal with soft elastic resin material 12*c*, such as polyurethane. The base part of each semicircular arc frame member 12 is connected, in such a manner so as to permit a free rotating motion, in a rigid joint coupling with a top part of the upright part 15*a* of a pair of L-letter-shaped rotating arms 15. The L-letter-shaped rotating arms 15 are held on the symmetrical axial line l in the forward and backward directions as fixed in relation to the guide rail 17 (the frame 17), which forms a part of the base plate 14. The rotating mechanism has a solid rotating shaft 21 and a hollow rotating shaft 22 joined respectively into the inner side and outer side of a fixing bushing 20 rigidly fixed on the base plate 14, and these rotating shafts are integrated into one unit with the base part of each of the individual rotating arms 15 on the upper side and on the lower side. Furthermore, the individual rotating shafts 21 and 22 may be arranged symmetrically in separate positions. Moreover, while not out of necessity, the fore ends parts of the guide links 24, connected coaxially in hinged joint coupling with a slider 18, are connected symmetrically in hinged joint coupling to the bottom area of the horizontal part 15*b* by way of a pin 25 which works concurrently as a locking pin. The slider 18 is guided by the guide rail 17 arranged o the symmetrical outward edges of the base plate 14. Owing to this guide link mechanism, the individual semicircular arc frame members 12 securely perform their smooth symmetrical movement.

More particularly, the semicircular arc frame members 12 perform their rotating movement, thereby setting the base plate 14 in the rear downward direction, which applies force to the frame member in its opening direction, and also a locking means is provided for maintaining the protective frame 11 in its closed state.

The angle of inclination $\alpha$ of the base plate mentioned above is sufficient if it is set at a value not less than the angle which generates a force (due to gravity) large enough to overcome the friction resistance or the like generated between the slider 18 and the guide rail 17, thereby to elicit the downward sliding movement of the slider 18. Typically, the angle is determined on the basis of the balance with such factors as the area of the seat 3 which has to be formed on the base plate 14. Ordinarily, the value of the angle of inclination is in the range from 10 to 30 degrees.

The locking means is desirably formed symmetrically to the individual rotating arms 15, and, specifically, the locking means is provided with a pair of locking pins 25, which are formed symmetrically in the intermediate part of the bottom area of the horizontal part 15*b*. Further present are a pair of locking holes 26, into which the protective frame 11 is joined in the closed state, and a rotating motion locking plate 27, which is arranged on the opposite sides of a symmetrical line l on the base plate positioned between them. The rotating motion locking plate 27 is made in such a way as to be capable of rotating from a lock position to a lock release position (i.e. the position of the two-dot chain line in FIG. 8) by the operation of the lock release lever 28 formed as part of the locking plate 27 and also capable of returning to the locking position by force of the spring. The spring force is given by means of a scissors-shaped coil spring 30 installed on a rotating shaft 29 of the rotating motion locking plate 27. Moreover, the fore end side, i.e. the back end side, of the locking plate 27 is made into an introducing slope area 27*a* and is so constructed as to be capable of moving until the locking pin 25 mentioned above pushes the locking plate 27 downward in resistance to the force of the spring and puts the locking plate 27 into a locking hole 26. This locking mechanism is installed in a position away from the reach of any legs or hands when the infant is put in the chair, as illustrated in FIG. 2 and FIG. 3, and is therefore favorably designed to avoid a possibility that the locking state may be released by mistake.

The mode of use of the second embodiment mentioned above is explained below.

Figure 3:
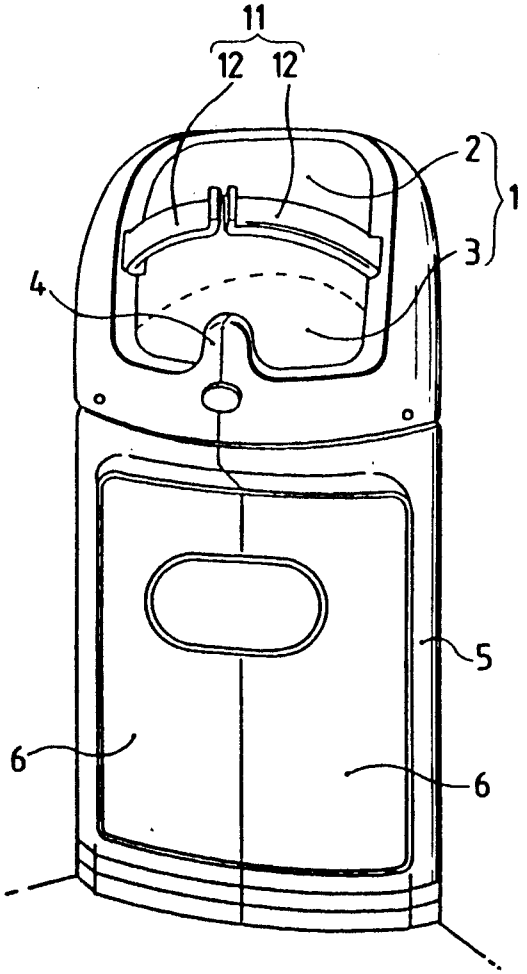
FIG. 3 is a perspective view illustrating a complete form of the infant chair with the said protective frame members in a closed state.
Figure 2:
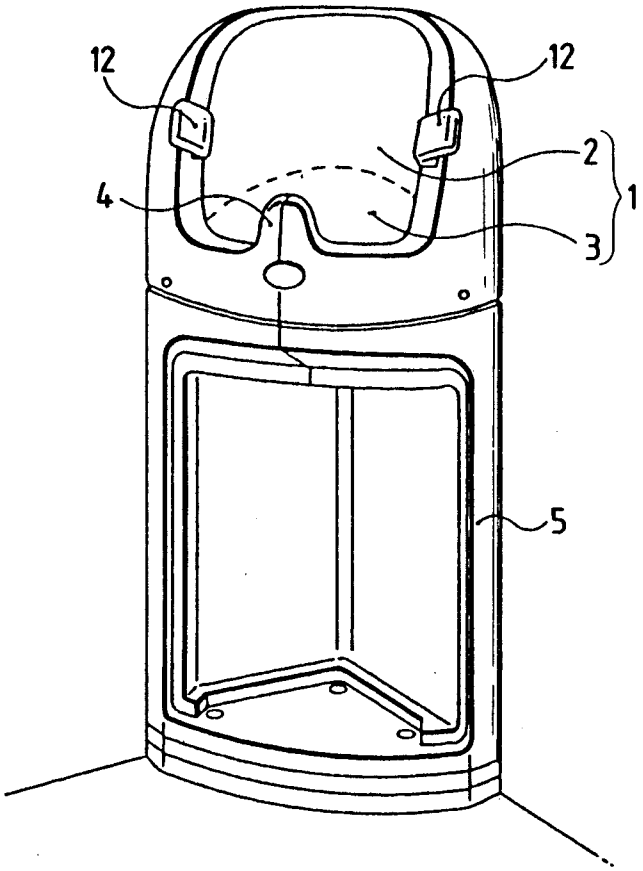
FIG. 2 is a perspective view illustrating a completed form of the infant chair with the protective frame members in an opened state.
Figure 4:
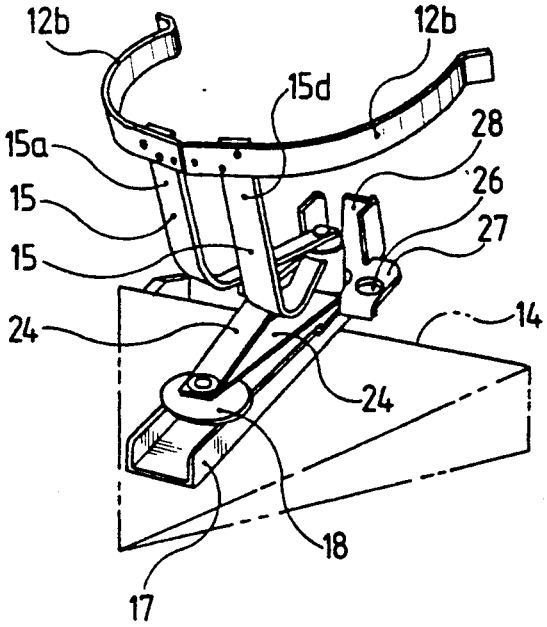
FIG. 4 is a rear perspective view illustrating the opening and closing mechanism for the protective frame members of the infant chair with the frame members kept in an opened state.
Figure 5:
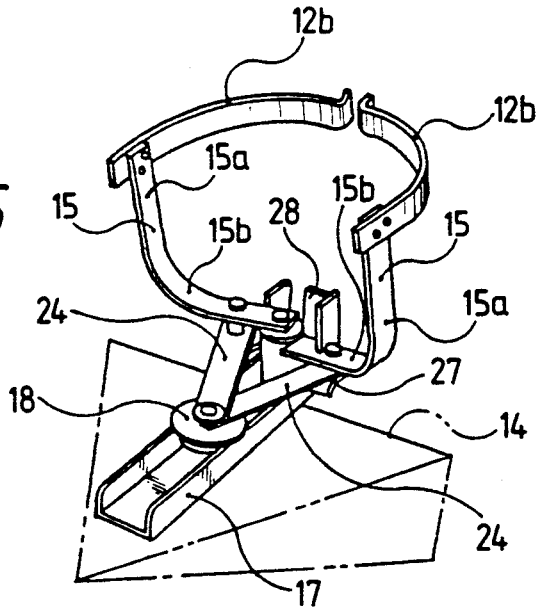
FIG. 5 is similarly a rear perspective view illustrating the opening, and closing mechanism for the protective frame members of the infant chair with the frame members kept in a closed state.
Figure 6:
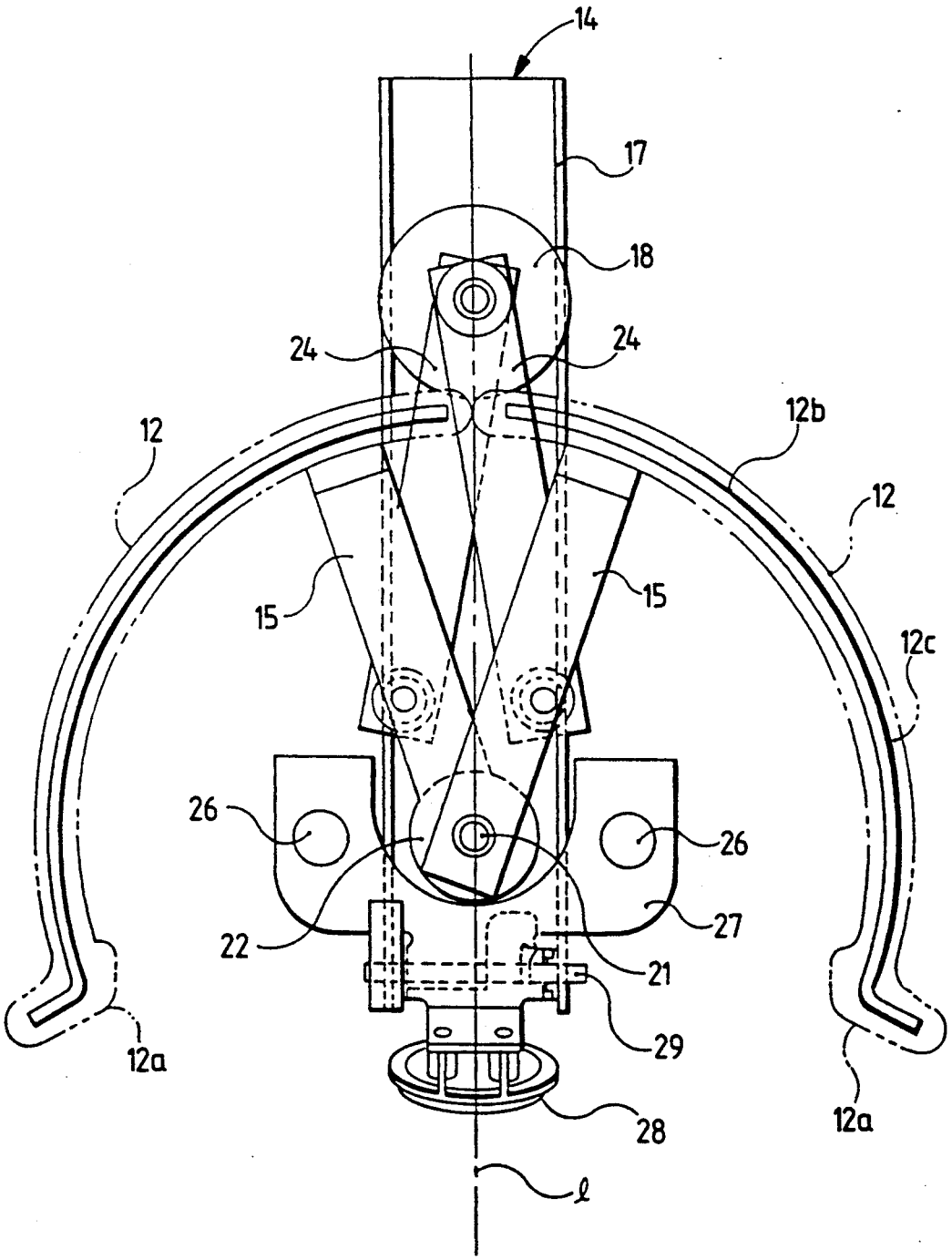
FIG. 6 is an enlarged plane view corresponding to FIG. 4.
Figure 7:
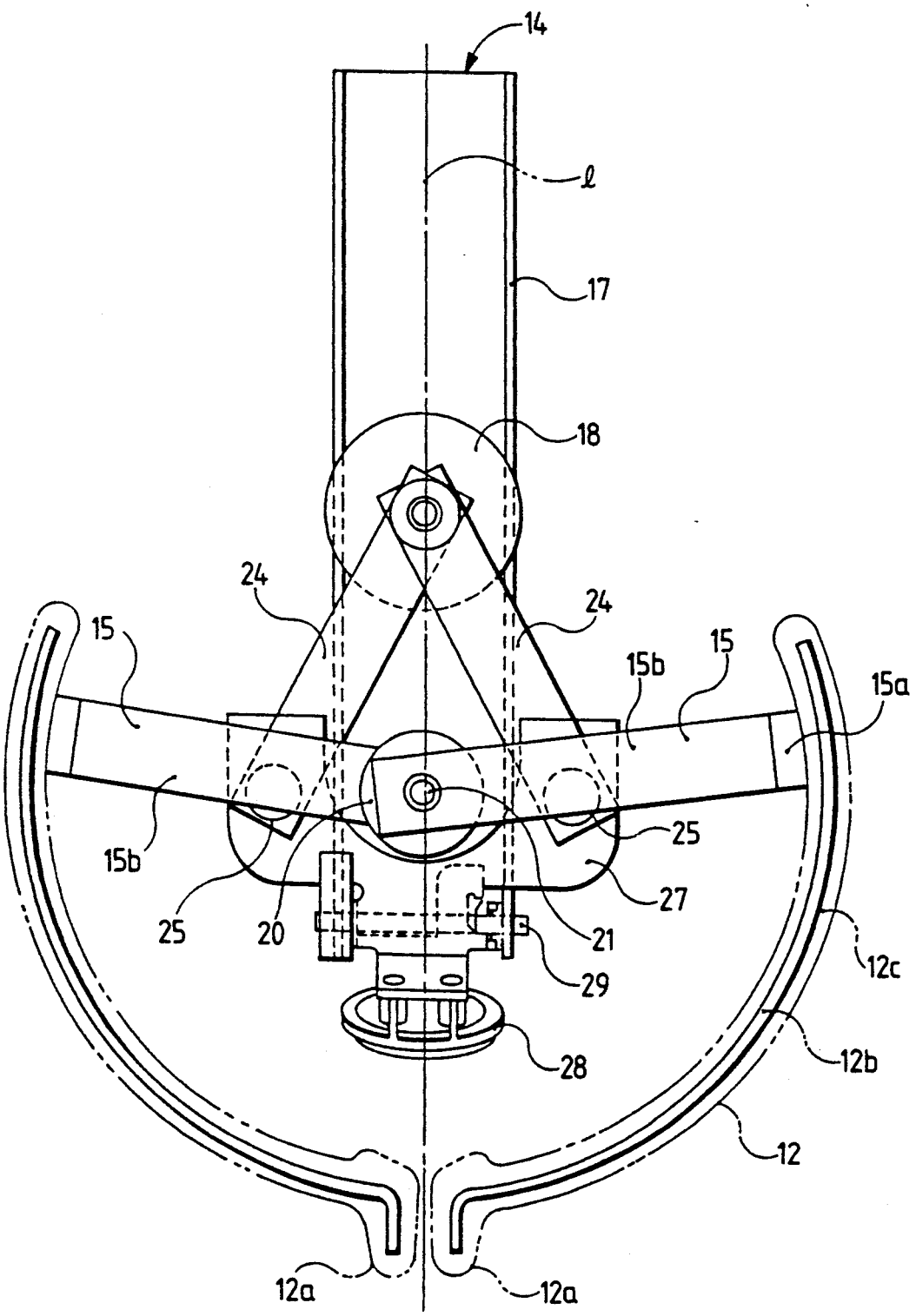
FIG. 7 is similarly an enlarged plane view corresponding to FIG. 5.
Figure 8:
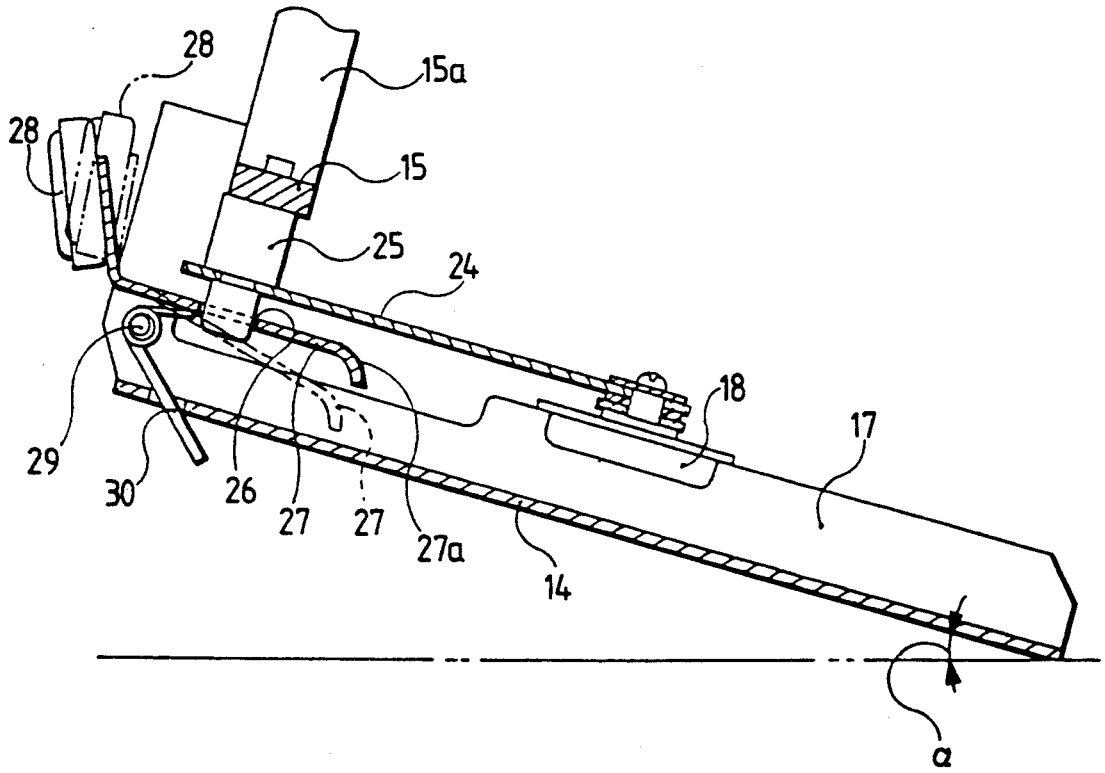
FIG. 8 is a sectional view for illustrating the locking mechanism with the back area omitted.

Ordinarily, the chair is installed by fixing it in a corner of a lavatory compartment, as illustrated in FIG. 2 and FIG. 3. Usually, the lock is released, and each of the semicircular arc frame members 12 is almost entirely accommodated in the main body 1 of the chair, except for the grip part 12*a* at the fore end of the frame member, the frame members thus remaining in the open state.

Then, when the infant is to be put in the chair, the infant is seated on the seat 3. At this time, the semicircular arc frame members 12 are accommodated in the main body 1 of the chair, and it is therefore possible to seat the infant by moving him horizontally from a point approximately in the front of the chair. Hence, it is not necessary to let the infant sit on the seat from a point over the chair, as was the case with the conventional infant chair, and it is not necessary to lift the infant to a high level, either.

Then, the semicircular arc frame members 12 are turned by manual operation in a closing direction and closed and locked. At this point, the locking pin 25 moves to the locking position by its sliding motion on the locking plate 27 and is locked automatically by the force of the spring.

Conversely, when the infant is to be removed from the chair, the lock release lever 28 is first pushed in towards the side of the main body 1 of the chair. Then, the clamping of the locking pin 25 and the locking hole 26 is put into a released state as the locking plate 27 turns downward in its rotating motion in resistance to the force of the spring, as shown by the two-dot chain line in FIG. 8. At this time, the slider 18 slides backward on the guide rail 17, as the base plate is inclined backward, and the lock is released completely, and, at the same time, the individual semicircular arc frame members 12 are automatically retracted almost entirely into the main body 1 of the chair for their accommodation therein. Therefore, when the infant is to be removed from the chair, it will be sufficient to draw the infant to this side, and it is possible easily to withdraw the infant from the chair since there is practically nothing interfering with the motion for withdrawing the infant, unlike the case with the conventional infant chair.

The present invention as embodied in the embodiment mentioned above offers the following advantageous effects.

When the infant is to be seated on the seat 3, it is possible to seat the infant by moving him horizontally from a point approximately in front of the chair owing to the fact that almost the entire structure of the semicircular arc frame members is accommodated in the main body 1 of the chair. Hence, it is not necessary to place the infant on the seat from a point over the chair, and, when the infant is seated, there is nothing interfering with the infant's legs, etc., and it is moreover not necessary to lift the infant to a high level, either. Therefore, it is easy to put the infant in the infant chair.

When the lock is released, almost the entire structure of the semicircular arc frame members 12 is automatically retracted into the inside area of the main unit 1 of the chair because force working in the opening direction is applied to the semicircular arc frame members 12. Therefore, when the infant is to be removed from the chair, it will be sufficient to draw the infant to this side, and it is possible easily to remove the infant since there is practically nothing interfering with withdrawal of the infant, unlike the case with the conventional infant chair.

Further, the embodiment described above is constructed simply by providing a force-applying means composed of a base plate set at an angle of inclination, and, in comparison with an infant chair in which a force-applying means composed, for example, by connecting a coil spring or the like to the slider, this embodiment can be constructed with a reduced number of component parts and consequently in a reduced number of assembly work processes. Furthermore, by the effect of the inclination of the base plate, the area needed for the installation of the infant chair is reduced, with the advantage that it is made possible to achieve a relative saving of space.

Also, the locking means is comprised of a pair of locking pins 25 which are formed symmetrically on the rotating arm 15, and a rotating motion locking plate 27 provided with a pair of locking holes 26, which are joined for clamping in the closed state of the protective frame 11, and arranged on the base plate. The rotating motion locking plate 27 is made in such a way as to be capable of moving in rotating motion from the locking position to the lock release position by operation of the lock releasing lever 28 formed on this side in connection with the locking plate 27 and capable of returning to the locking position by force of a spring. Hence, when the infant is to be put in the chair, the infant is seated on the seat and thereafter the semicircular arc frame members 12 are turned by manual operation in the closing direction. Then, the locking pin 25 moves in its sliding motion on the locking plate 27 to the locking position, when the pin is locked automatically by force of the spring. Conversely, when the seated infant is to be removed from the chair, the lock release lever 28 is first pushed in towards the side of the main body 1 of the chair, and the locked state is released.

Therefore, it is possible to remove the infant from the chair with greater ease.

Furthermore, this locking mechanism is installed in a position away from the reach of the legs or the hands when the infant is put in the chair, and this mechanism therefore offers safety, relieving any apprehension that the locking state may be released by mistake.

What is claimed is:

1. An infant restraining chair adapted for use with an infant having a waist and abdominal region and adapted to be positioned on a substantially level support, comprising:

a chair member having a front and a rear for seating said infant therein;

a restraining frame member which can be selectively extended and retracted from within said chair member, said frame member in a fully extended position restraining said waist and abdominal region of said infant seated in said chair member, said restraining frame member including an arcuate seat belt member having a substantially rigid construction, said arcuate seat belt member being selectively rotatable to a retracted position in which said arcuate seat belt member is substantially accommodated within said chair member, and being selectively rotatable out of said chair member to encircle and restrain said infant within said chair member; and securing means for selectively securing said restraining frame member in a fully extended position, said securing means including a retraction member coupled to said arcuate seat belt member, said retraction member including means for constantly applying force to said arcuate seat belt member to bias said arcuate seat belt member toward said retracted position, said retraction member being inclined said means for constantly applying force being the mounting of said retraction member at an incline with respect to the horizontal said substantially level support to generate said force by gravity said retraction member being retractable rearwardly and downwardly.

2. A chair as claimed in claim 1, wherein said support comprises a column support member supporting said chair member at a predetermined height, wherein said chair member and said column support member have a predetermined shape for installation in a predetermined area.

3. A chair as claimed in claim 2, wherein a cross-section of said column support member has a generally triangular shape, to facilitate installation of said chair in a corner area.

4. A chair as claimed in claim 3, wherein said securing means further comprises a lock member for locking said arcuate seat belt member in a restraining position.

5. A chair as claimed in claim 4, wherein said chair member comprises a body support member for supporting and surrounding a substantial portion of said infant, and having an open front end to insert and remove said infant onto and from said body support member while said restraining frame member is in said retracted position.

6. A chair as claimed in claim 2, wherein said chair member further comprises a crotch holder member comprising a projection from a surface of said chair member, said crotch holder member preventing the infant from slipping out of said chair member.

7. A chair as claimed in claim 1, wherein said securing means further comprises lock members for locking said arcuate seat belt member in a restraining position.

8. An infant restraining chair adapted for use with an infant having a waist and abdominal region comprising:

a chair member for seating said infant therein;

a restraining frame member which can be selectively extended and retracted from within said chair member, said frame member in a fully extended position restraining said waist and abdominal region of said infant seated in said chair member, said retraining frame member including an arcuate seat belt member having a substantially rigid construction, said arcuate seat belt member being selectively rotatable to a retracted position in which said arcuate seat belt member is substantially accommodated within said chair member, and being selectively rotatable out of said chair member to encircle and restrain said infant within said chair member; and securing means for selectively securing said restraining frame member in a fully extended position, said securing means including a retraction member coupled to said arcuate seat belt member for constantly applying force to said arcuate seat belt member to bias said seat belt member toward said retracted position, and a lock member for locking said arcuate seat belt member in a restraining position, said retraction member generating said force by gravity, wherein said retraction member comprises a base plate, a guide rail inclined with respect to said base plate at a predetermined angle; a slider movable along said guide rail by the force of gravity; and a connection member connecting said slider with said arcuate seat belt member.

9. A chair as claimed in claim 8, wherein said lock member includes a pair of locking pins formed symmetrically on said connection member, and a rotating motion locking plate provided with a pair of locking holes, said locking pins and locking holes being joined together for locking said arcuate seat belt member in said retraining position.

10. A chair as claimed in claim 9, further comprising:

a lock release member for releasing said arcuate seat belt member from said restraining position.

* * * * *